US008690115B2

(12) United States Patent
Rodecker et al.

(10) Patent No.: US 8,690,115 B2
(45) Date of Patent: Apr. 8, 2014

(54) LEAF SPRING BRACKET

(75) Inventors: Troy P. Rodecker, Berlin Heights, OH (US); Jason R. Porter, Jackson, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 175 days.

(21) Appl. No.: 13/154,529

(22) Filed: Jun. 7, 2011

(65) Prior Publication Data

US 2012/0312954 A1 Dec. 13, 2012

(51) Int. Cl.
*F16M 13/00* (2006.01)

(52) U.S. Cl.
USPC ..... 248/617; 248/65; 422/310

(58) Field of Classification Search
CPC ... F01N 3/28; F01N 2450/08; F01N 2450/24; F01N 13/18; F16L 23/036
USPC ..... 248/617, 65, 62, 67.5, 73, 74.1, 74.4, 248/74.5, 671, 229.14, 229.24, 227.4, 248/231.61, 505, 229.13, 229.23, 230.4, 248/231.51; 422/310, 168, 177, 179, 49; 285/373, 415
See application file for complete search history.

(56) References Cited

U.S. PATENT DOCUMENTS

| | | | | |
|---|---|---|---|---|
| 2,684,825 | A * | 7/1954 | Laviana et al. | 410/49 |
| 3,245,643 | A * | 4/1966 | Morrow | 248/542 |
| 4,730,852 | A * | 3/1988 | Arscott | 285/15 |
| 6,053,652 | A * | 4/2000 | Deaver et al. | 403/24 |
| 2012/0056070 | A1 * | 3/2012 | Rodecker | 248/636 |

FOREIGN PATENT DOCUMENTS

| | | |
|---|---|---|
| JP | 2002-021554 | 1/2002 |
| JP | 2010-214354 | 9/2010 |
| WO | 2008-154564 | 12/2008 |
| WO | 2009-118746 | 10/2009 |

* cited by examiner

*Primary Examiner* — Anita M King
(74) *Attorney, Agent, or Firm* — Harness, Dickey & Pierce, P.L.C.

(57) ABSTRACT

A system for mounting a catalytic converter of an exhaust system to an internal combustion engine includes a bracket adapted to fix the catalytic converter to the engine. A strap is adapted to circumferentially extend about a portion of the catalytic converter and clamp the catalytic converter to the bracket. The bracket includes a seat, a mounting pad and a compliant portion interconnecting the seat and the mounting pad. The seat supports a portion of the catalytic converter opposite the strap. The compliant portion includes a slot extending adjacent to the seat to reduce the stiffness of the bracket and allow the bracket to deflect during thermal expansion of the catalytic converter.

21 Claims, 9 Drawing Sheets

LEAF SPRING BRACKET

FIELD

The present disclosure relates to a mounting arrangement for an automotive exhaust system. More particularly, the present disclosure relates to a leaf spring bracket for mounting a catalytic converter to an engine of a vehicle.

BACKGROUND

This section provides background information related to the present disclosure which is not necessarily prior art.

Typically, automotive vehicles including cars and trucks have an internal combustion engine (gasoline or diesel) which is coupled to a transmission and an axle assembly for providing power to the driven wheels of the vehicle. An engine exhaust system which typically includes one or more exhaust pipes, one or more catalytic converters, one or more mufflers and one or more tailpipes is attached to the engine to quiet the combustion process, to clean the exhaust gases and to route the products of combustion away from the engine.

Some vehicles are equipped with catalytic converters positioned adjacent to or very near the engine. Due to the weight of the catalytic converters and proximity to the engine, brackets mounted directly to the engine block or heads have been used to support the converters. At least one known converter mounting bracket cooperates with one or more metallic mesh biscuits positioned between the converter and the bracket. The metal mesh is intended to act as a strain relief joint to account for thermal expansion of the converter during operation.

While the steel mesh biscuits may effectively reduce the stresses reached due to thermal expansion, these materials tend to crush and may permanently set during vehicle operation. A change in joint stiffness after minimal periods of use has also been noted. Unfortunately, changes in the characteristics of the steel biscuits also may cause changes in the noise, vibration and harshness characteristics of the exhaust system within the vehicle. Undesirable feedback to the vehicle operator may occur after a relatively short period of vehicle operation.

Other catalytic converter mounting systems including elastomeric plastics or rubbers have not succeeded due to the relatively high temperature operating environment in which the catalytic converter mount must function. Accordingly, it may be desirable to provide a robust, high-temperature catalytic converter mount to account for thermal expansion of exhaust components.

SUMMARY

This section provides a general summary of the disclosure, and is not a comprehensive disclosure of its full scope or all of its features.

A system for mounting a catalytic converter of an exhaust system to an internal combustion engine includes a bracket adapted to fix the catalytic converter to the engine. A strap is adapted to circumferentially extend about a portion of the catalytic converter and clamp the catalytic converter to the bracket. The bracket includes a seat, a mounting pad and a compliant portion interconnecting the seat and the mounting pad. The seat supports a portion of the catalytic converter opposite the strap. The compliant portion includes a slot extending adjacent to the seat to reduce the stiffness of the bracket and allow the bracket to deflect during thermal expansion of the catalytic converter.

A system for mounting a catalytic converter of an exhaust system to an internal combustion engine includes a monolithic bracket having a substantially constant thickness being adapted to fix the catalytic converter to the engine. The bracket includes a seat adapted to support a portion of the catalytic converter. A mounting pad and a compliant portion interconnects the seat and the mounting pad. The compliant portion includes first, second and third hinges having reduced cross-sections to allow relative movement between the seat and the mounting pad during thermal expansion of the catalytic converter.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
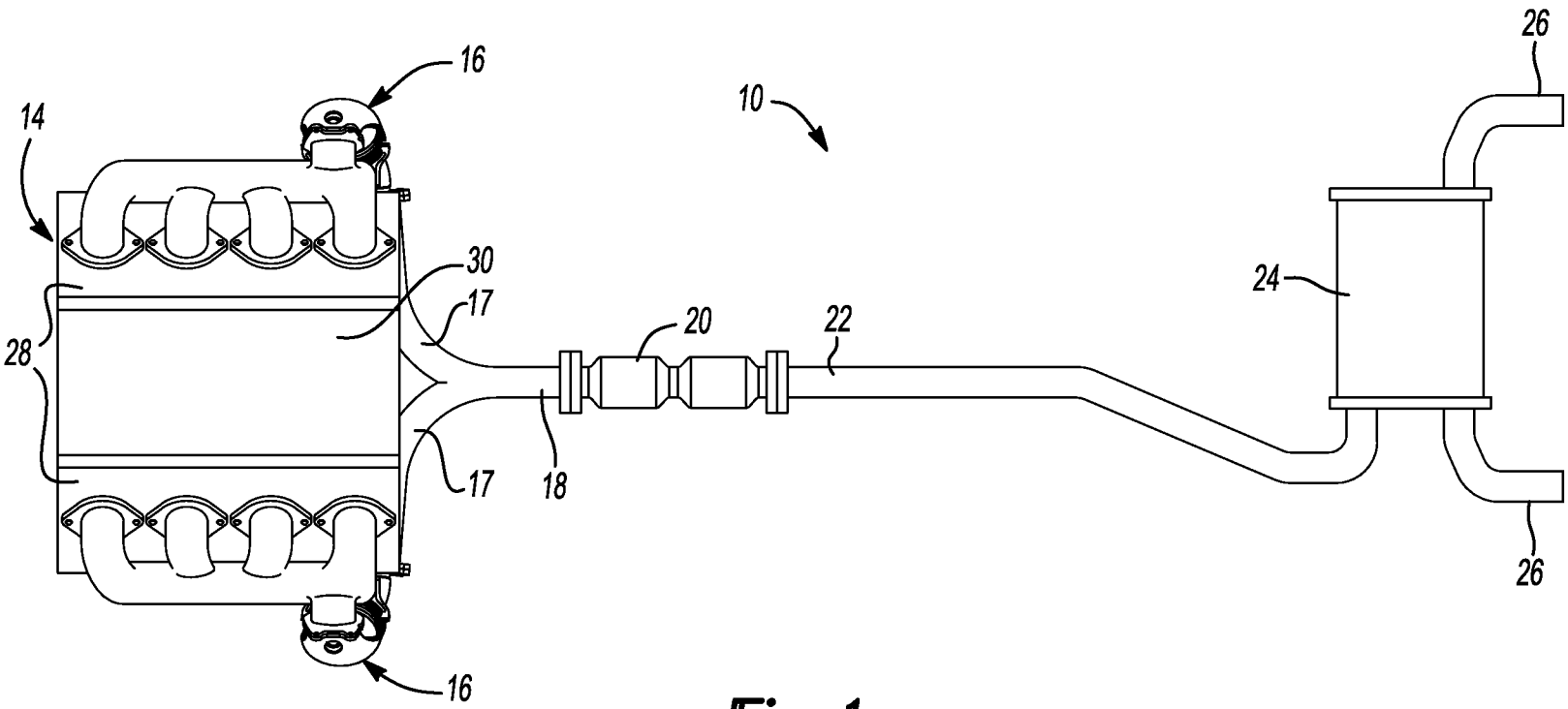
FIG. 1 is a schematic depicting an exemplary vehicle having an internal combustion engine and an exhaust system.
Figure 2:
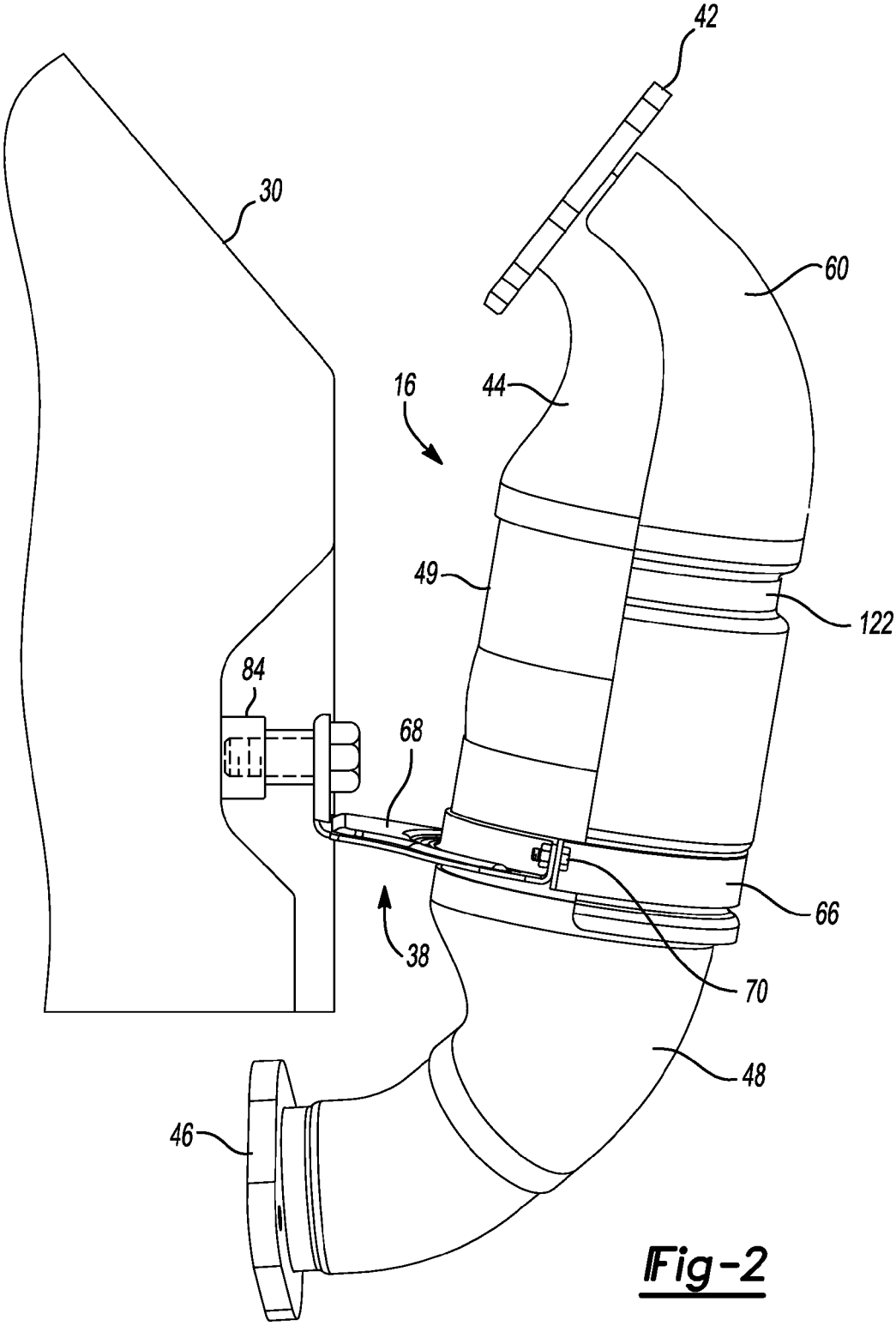
FIG. 2 is a fragmentary perspective view of a catalytic converter mounted to an engine with a leaf spring bracket according to the teachings of the present disclosure.
Figure 3:
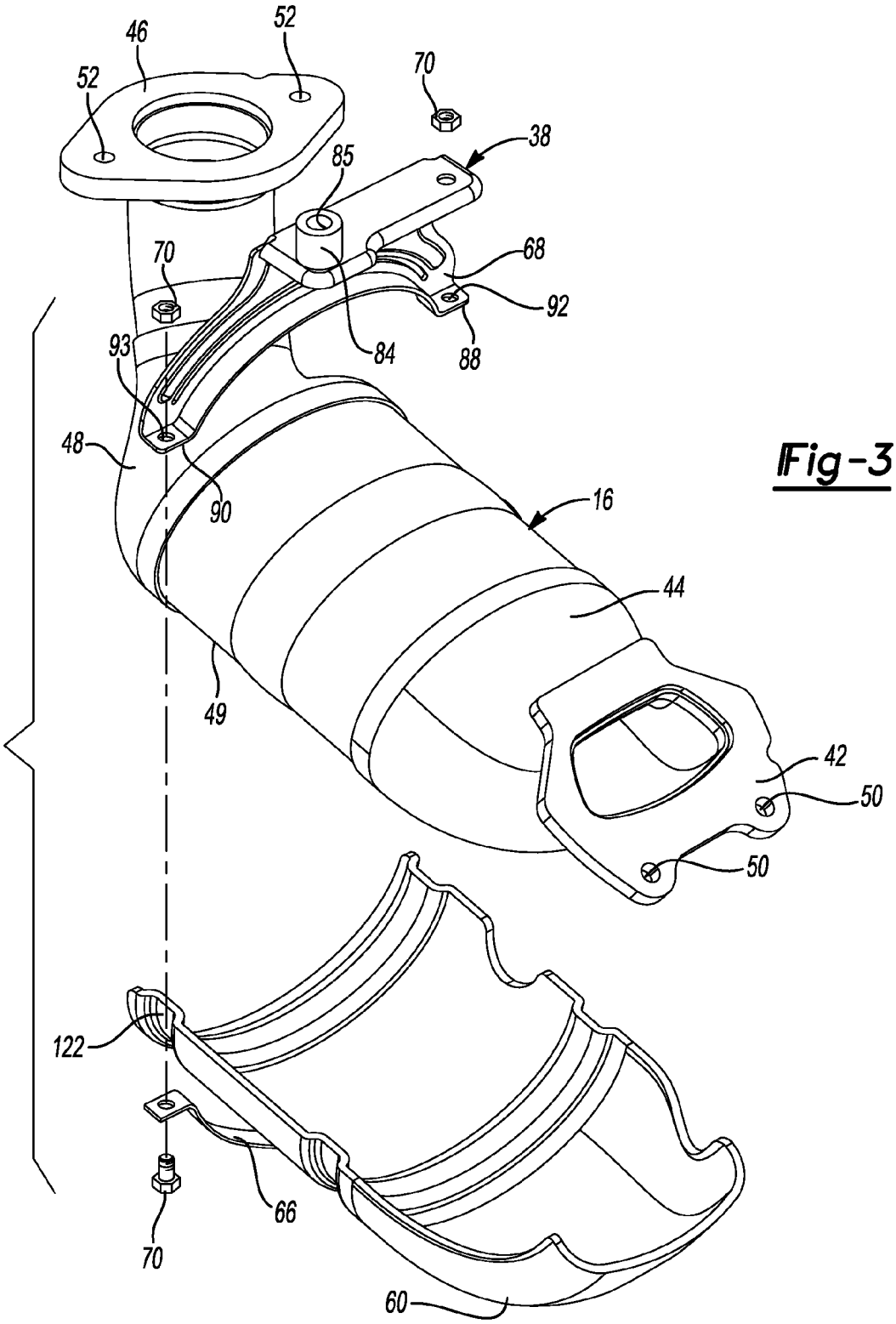
FIG. 3 is an exploded perspective view of a catalytic converter and bracket.
Figure 4:
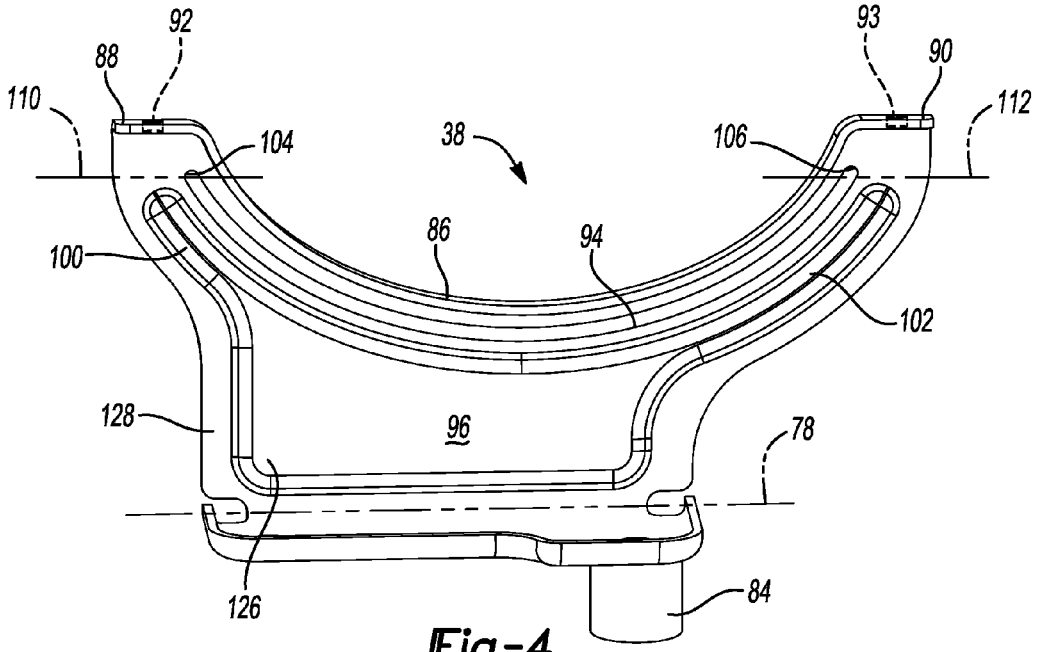
FIG. 4 is a front view of a portion of the bracket.
Figure 5:
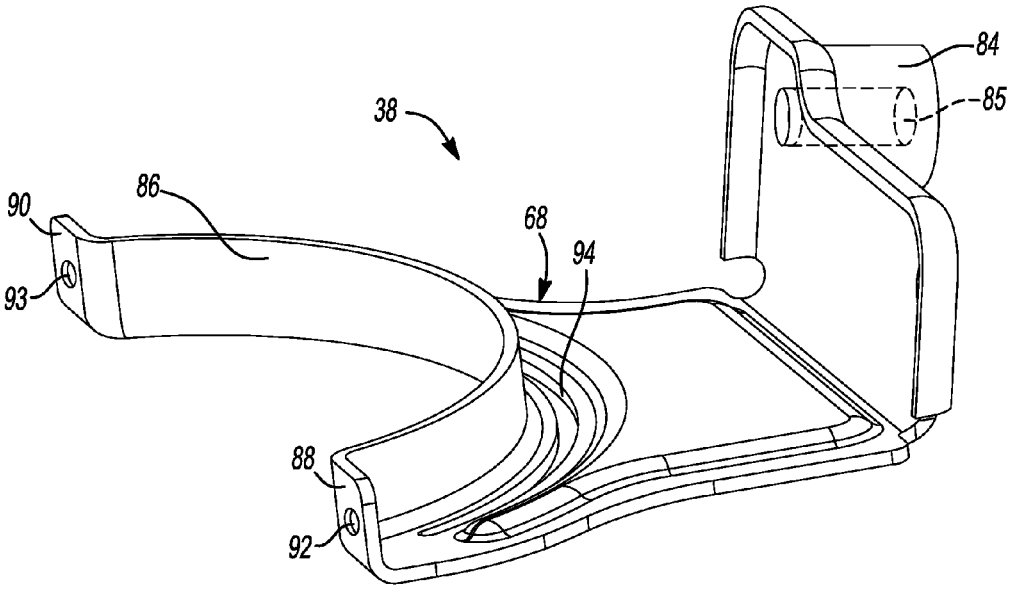
FIG. 5 is a perspective view of a portion of the bracket.
Figure 6:
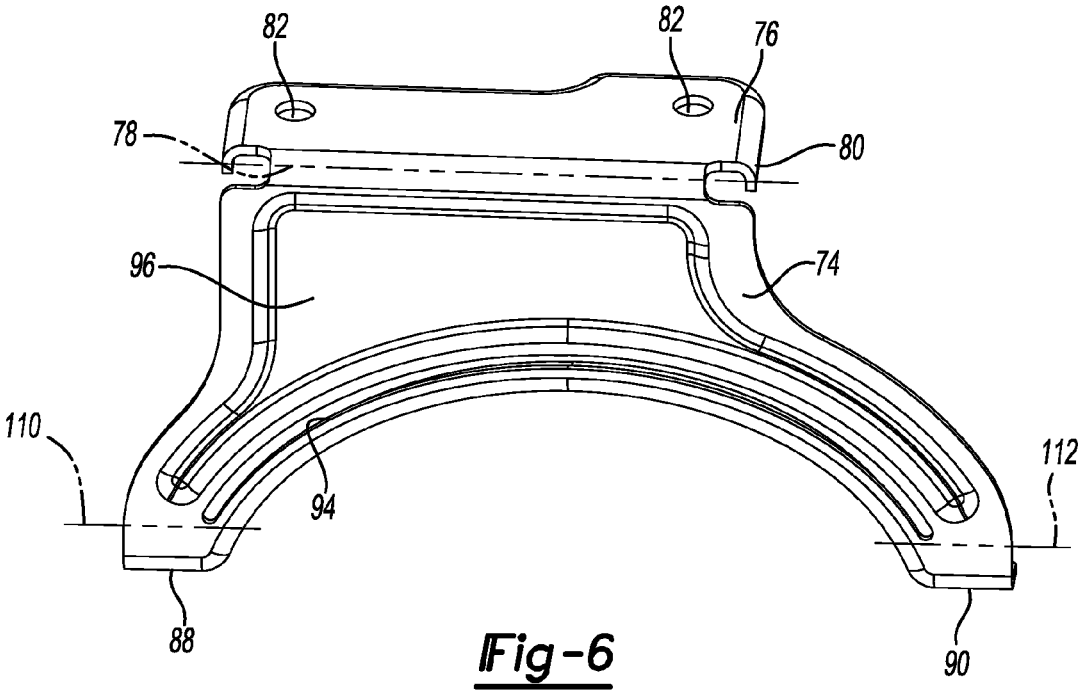
FIG. 6 is another perspective view of a portion of the bracket assembly.

Referring now to the drawings, in which like reference numerals designate like or corresponding parts throughout the several views, there is illustrated in FIG. 1 an exhaust system in accordance with the present disclosure and which is designated by the reference numeral 10. Exhaust system 10 is attached to an internal combustion engine 14. Internal combustion engine 14 is designed to provide power to one or more drive wheels of the vehicle through a transmission (not shown) and one or more axle assemblies (not shown).

Exhaust system 10 comprises a pair of forward catalytic converters 16, a pair of forward exhaust pipes 17, a mid-pipe 18, a rear catalytic converter 20, a rear exhaust pipe 22, a muffler 24, and a pair of tailpipes 26. As illustrated in FIG. 1, exhaust system 10 routes the products of combustion for internal combustion engine 14 to the rear of the vehicle.

While illustrated as routing products of combustion to the rear of the vehicle, exhaust system 10 can be configured to route the products of combustion to any peripheral location of the vehicle including but not limited to the side or sides of the vehicle.

Forward catalytic converters 16 are attached to a pair of heads 28 that are fixed to an engine block 30 of internal combustion engine 14. Exhaust flows in sequence through the forward catalytic converters 16, forward exhaust pipes 17, mid-pipe 18, rear catalytic converter 20, rear exhaust pipe 22, muffler 24 and dual tail pipes 26. It is within the scope of the present disclosure to have a single forward catalytic converter 16 attached to a single exhaust pipe to provide a single path exhaust system. It is also within the scope of the present disclosure to have the pair of forward catalytic converters 16 attached to a pair of mid-pipes 18 which can be attached to a pair of rear catalytic converters 20 which can be attached to a pair of rear exhaust pipes 22 which can be attached to a pair of mufflers 24 which can be attached to a pair of tailpipes 26 to provide a dual path exhaust system. Thus, exhaust system 10 can be configured to be a single path exhaust system, a dual path exhaust system or any other configuration of exhaust system known in the art.

Each forward catalytic converter 16 is fixed to engine block 30 by a mounting bracket assembly 38. Each forward catalytic converter 16 includes a first mounting flange 42 fixed to an inlet cone 44 as well as a second flange 46 fixed to an outlet cone 48. An outer shell 49 is positioned between and fixed to inlet cone 44 and outlet cone 48. First flange 42 includes a plurality of apertures 50 for receipt of fasteners (not shown) to fix forward catalytic converter 16 to one of heads 28. Second flange 46 includes a pair of apertures 52 for receipt of fasteners interconnecting forward catalytic converter 16 with forward exhaust pipe 17. Due to the substantial mass of each catalytic converter 16, bracket assembly 38 is spaced apart from first flange 42 to further support converter 16 at head 28.

As shown in FIGS. 2-7, bracket assembly 38 also couples a heat shield 60 to outer shell 49 of forward catalytic converter 16. Bracket assembly 38 includes a strap 66 fixed to a bracket 68 with fasteners 70. Bracket 68 is preferably stamped from a sheet of metal having a substantially constant thickness. Bracket 68 includes a substantially planar plate 74 monolithically formed with and intersecting a mounting tab 76 at substantially 90 degrees. A first hinge 78 interconnects plate 74 and mounting tab 76. A rolled flange 80 extends about the periphery of mounting tab 76 to increase its stiffness. A pair of apertures 82 extends through mounting tab 76. A separately formed stanchion 84 is fixed to mounting tab 76 to orient bracket assembly 38 relative to internal combustion engine 14. The axial length of stanchion 84 is set according to the desired orientation of bracket assembly 38 and forward catalytic converter 16. A through bore 85 extends through stanchion 84 and is aligned with one of apertures 82 for receipt of fasteners (not shown) for fixing bracket assembly 38 to engine block 30.

Plate 74 includes a semi-cylindrically shaped seat 86, a first land 88, and a second land 90. First land 88 includes an aperture 92 and second land 90 includes an aperture 93 for receipt of fasteners 70 for fixing strap 66 to bracket 68. It should be appreciated that lands 88, 90 are integrally formed with and continuously extend from seat 86. Seat 86 has a curvilinear shape sized to conform to an outer surface of outer shell 49. Similarly, strap 66 has a curved shape sized to mate with a bottom groove surface 122 of heat shield 60. As such, bracket assembly 38 couples forward catalytic converter 16 and heat shield 60 to internal combustion engine 14.

An arcuate slot 94 extends through plate 74. A protrusion 96 is positioned adjacent to slot 94 to stiffen bracket 68. Portions of protrusion 96 are shaped as first and second ribs 100, 102. The position of ends 104, 106 of slot 94 and distal ends of ribs 100, 102 define portions having a reduced bending stiffness identified as second and third hinges 110, 112 respectively.

In operation, flange 42 fixes one end of forward catalytic converter 16 to one of heads 28. Bracket assembly 38 fixes another portion of forward catalytic converter 16 to engine block 30. Bracket assembly 38 functions as a Y-shaped leaf spring having a predetermined compliance in one direction to account for the coefficient of linear thermal expansion of forward catalytic converter 16. The greatest magnitude of dimensional change of catalytic converter 16 occurs along the axis of exhaust flow. As such, bracket assembly 38 is configured to deflect at first hinge 78, second hinge 110 and third hinge 112 to maintain bracket internal stresses at acceptable levels as forward catalytic converter 16 lengthens during heating. Furthermore, bracket assembly 38 exhibits a substantially increased stiffness in the other two directions orthogonal to the direction of exhaust flow. Accordingly, a robust structural catalytic converter mount may be provided that is operable to account for the thermal expansion of the catalytic converter when its operating temperature changes from atmospheric ambient temperature to a maximum exhaust gas temperature. It is contemplated that forward catalytic converter 16 may be exposed to exhaust gas temperatures exceeding 700° C.

Depending on the mass of forward catalytic converter 16, the magnitude of thermal expansion and the orientation of forward catalytic converter 16 relative to the ground, it may be desirable to change the stiffness of bracket assembly 38. In particular, the magnitude of an offset between a surface 126 of protrusion 96 and a surface 128 of plate 74 may be varied. In the bracket depicted in the Figures, the offset is approximately 2 mm. If greater stiffening is required, a larger offset may be formed. Similarly, the circumferential extent of slot 94 may be changed to change the stiffness of leaf spring bracket 68.

Figure 7:
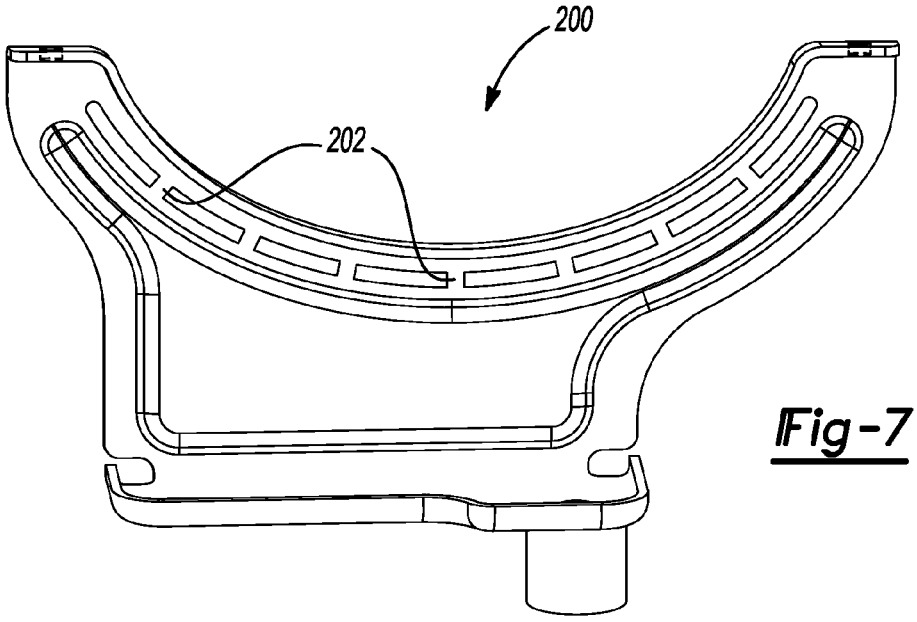
FIG. 7 is a front view of an alternate bracket.

An alternate bracket assembly is depicted in FIG. 7 and identified at reference numeral 200. Bracket assembly 200 is substantially similar to bracket assembly 38. Accordingly, only the differences between the two will be described. Bracket assembly 200 includes a plurality of webs 202 radially extending across slot 94 to change the stiffness of the bracket. Webs 202 are circumferentially spaced apart from one another to provide additional load paths during operation.

Figure 8:
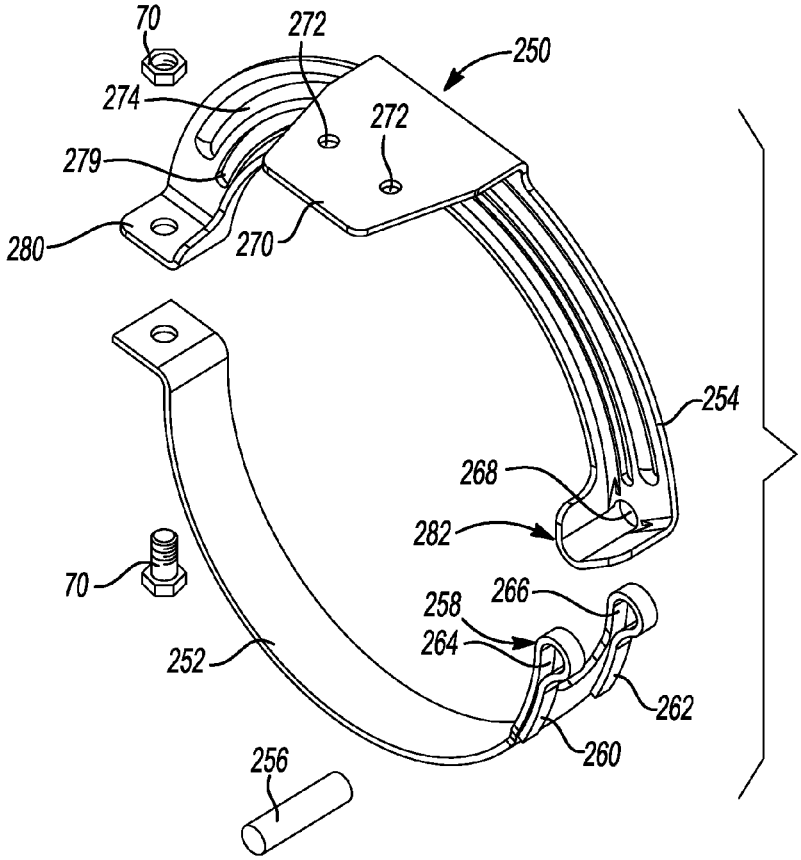
FIG. 8 is an exploded perspective view of another alternate bracket assembly.
Figure 9:
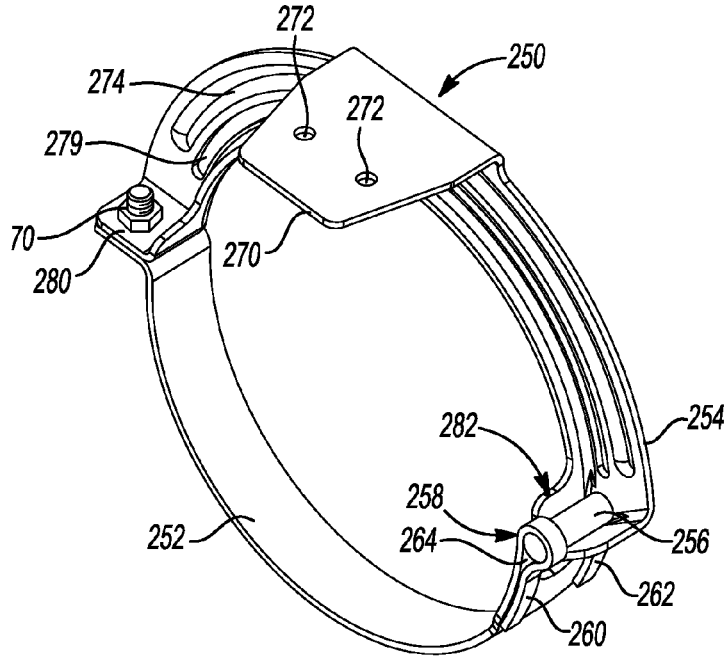
FIG. 9 is a perspective view of the alternate bracket assembly depicted in FIG. 8.
Figure 10:
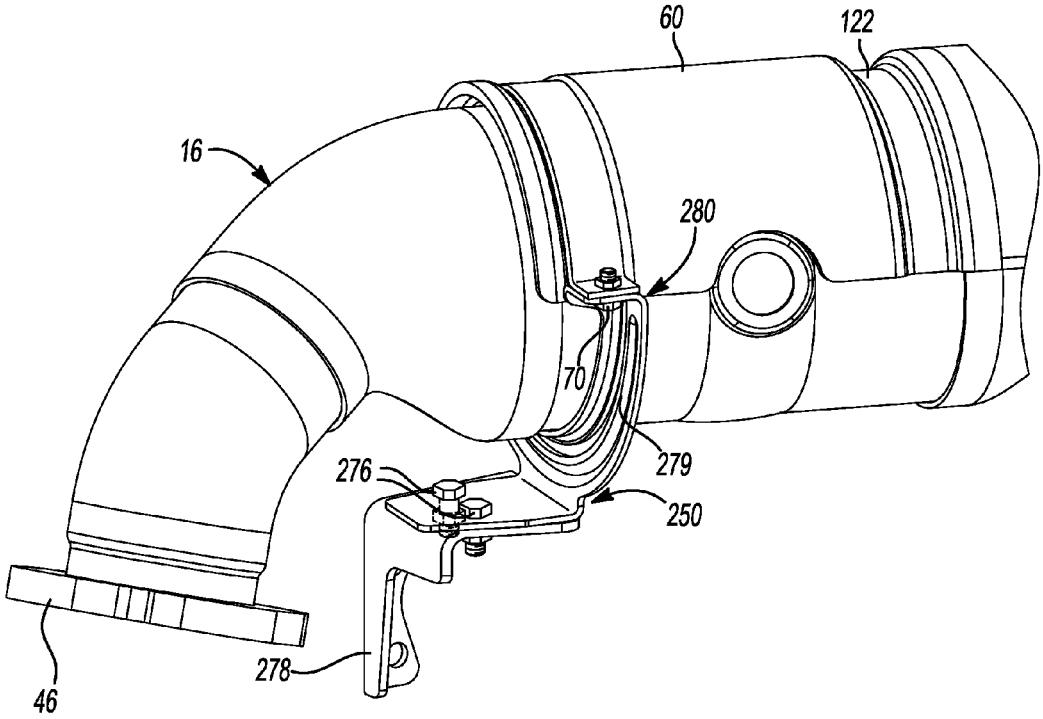
FIG. 10 is a perspective view of a catalytic converter coupled to the bracket depicted in FIGS. 8 and 9.

FIGS. 8-10 depict another alternate bracket assembly identified at reference numeral 250. Bracket assembly 250 is substantially similar to bracket assembly 38 except that a strap 252 is pivotally coupled to a bracket 254 by a pin 256. A hinged end 258 of strap 252 includes folded over tabs 260, 262 forming eyelets 264, 266. An aperture 268 extends through bracket 254. Pin 256 may be press-fit within aperture 268 after extending through eyelets 264 and 266. Once the assembly is complete, strap 252 is pivotally coupled to bracket 254. One of fasteners 70 may couple the non-hinged end of strap 252 to bracket 254 as previously discussed in relation to bracket assembly 38.

Bracket 254 includes a simplified planar mounting tab 270. A pair of apertures 272 extend through mounting flange 270 for receipt of fasteners 276 that may be useful for fixing bracket 254 to another bracket 278 that may be fixed to engine block 30 or one of heads 28. The additional joint between bracket 254 and bracket 278 may be necessary due to the limited space available within an engine compartment of a vehicle. It is contemplated as part of the present disclosure to vary the stiffness of bracket 254 to account for the additional joint between bracket 254 and bracket 278. Examples of contemplated changes in structure include a change in the size and shape of a rib 274 as well as a change in the size and shape of a slot 279 extending through bracket 254. As previously described, changes in these geometrical features change the rate of the Y-shaped leaf spring portion formed between a land 280 and mounting tab 270 as well as the spring portion formed between a hinge end 282 and mounting tab 270.

Figure 11:
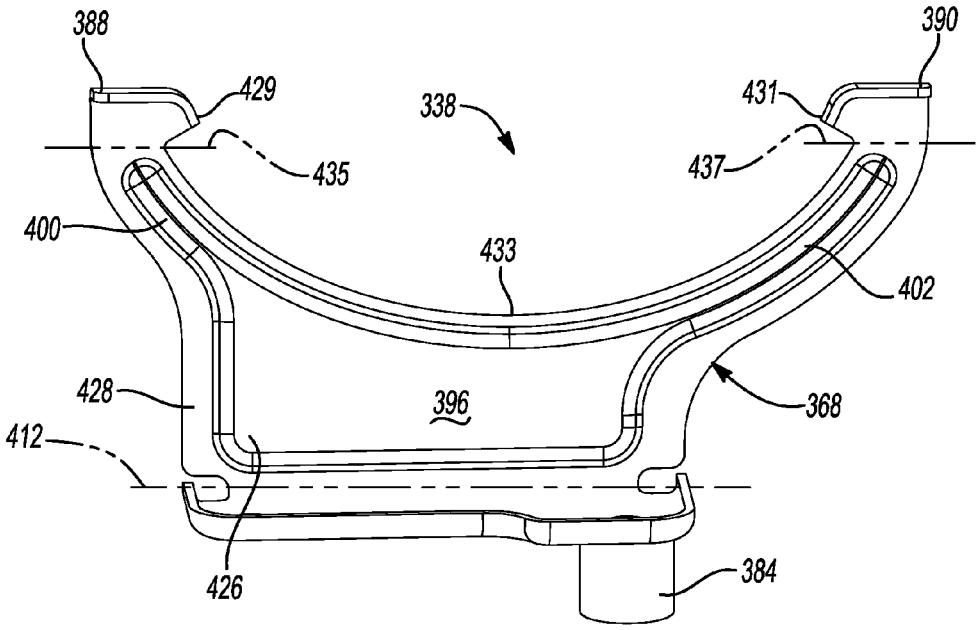
FIGS. 11 and 12 depict perspective views of another alternate bracket assembly.
Figure 12:
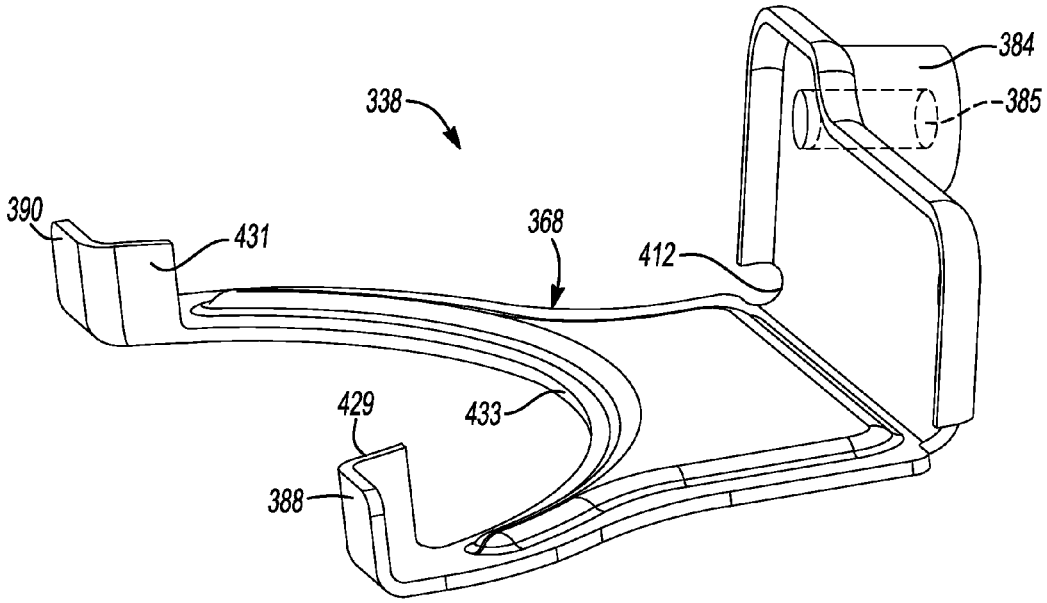

FIGS. 11 and 12 depict another alternate bracket assembly identified at reference numeral 338. Bracket assembly 338 is substantially similar to bracket assembly 38. Accordingly, like elements will be identified with similar reference numerals increased by 300.

Bracket assembly 338 does not include a strap for fixing catalytic converter 16 to a bracket 368. On the contrary, bracket 368 is fixed to catalytic converter 16 via a process such as welding. More particularly, a first seat 429 is integrally formed with and extends from first land 388. First seat 429 includes a curved shape and is sized to conform to and contact outer shell 49 of forward catalytic converter 16. Similarly, a second seat 431 is integrally formed with and extends from second land 390. Second seat 431 is also shaped to contact outer shell 49 of forward catalytic converter 16.

Once bracket assembly 338 is properly positioned relative to forward catalytic converter 16, first seat 429 and second seat 431 are fixed to outer shell 49 by a process such as welding. It should be appreciated that a singular semi-cylindrically shaped seat 86 is no longer provided in the embodiment depicted in FIGS. 11 and 12. First seat 429 and second seat 431 are circumferentially spaced apart from one another. A relief 433 extends between first seat 429 and second seat 431 to assure that a first hinge 435 and a second hinge 437 are provided to allow bracket 368 to deflect when forward catalytic converter 16 exhibits an increase in length due to its coefficient of thermal expansion. After bracket 368 is fixed to forward catalytic converter 16, relief 433 remains spaced apart from outer surface 49. Third hinge 412 remains as previously described in relation to third hinge 112.

Figure 13:
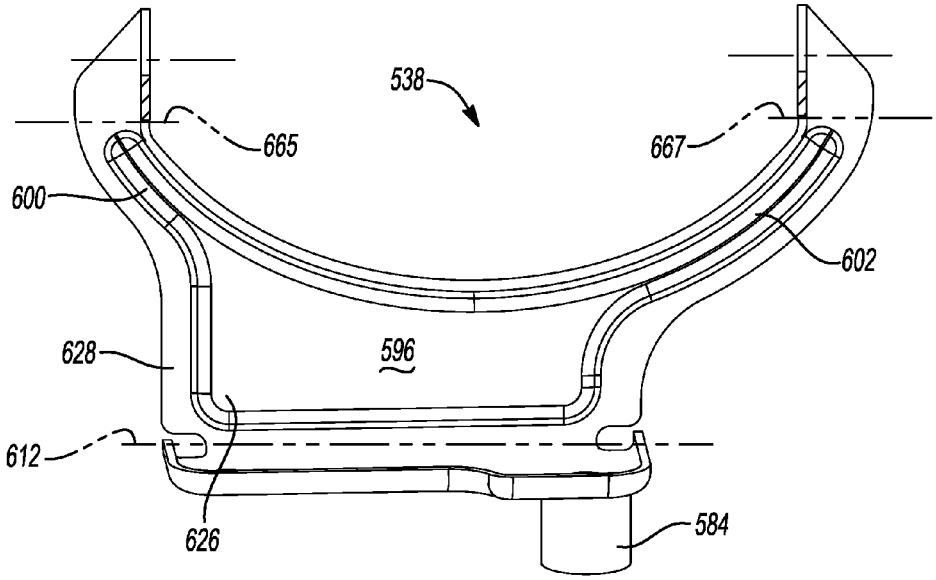
FIGS. 13 and 14 depict perspective views of another alternate bracket assembly.
Figure 14:
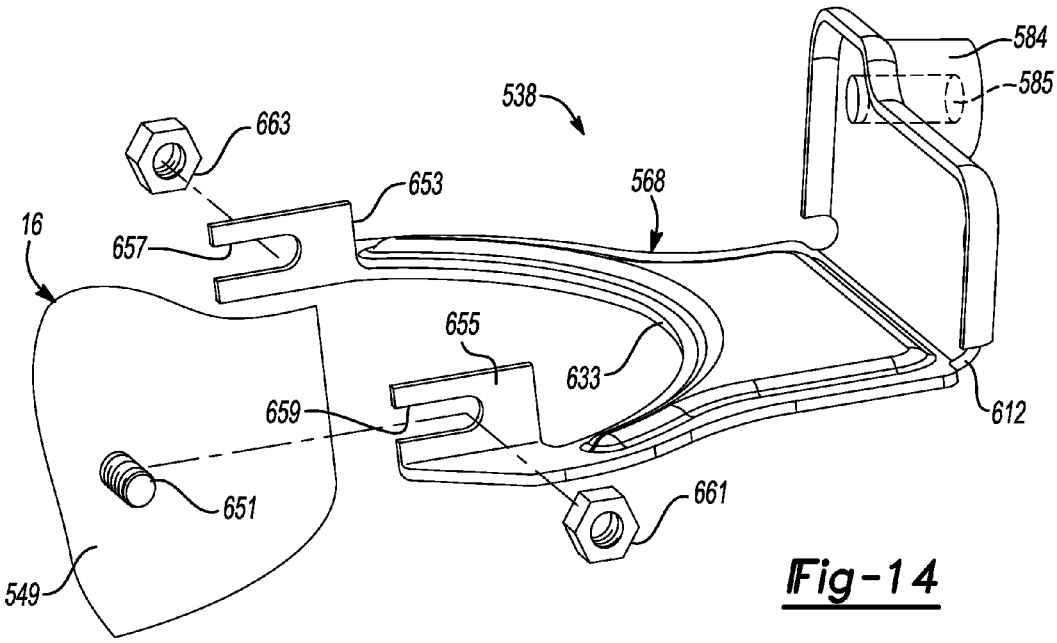

FIGS. 13 and 14 depict another bracket assembly 538. Bracket assembly 538 is substantially similar to bracket assembly 338 and like elements will be identified with reference numerals increased by 200. In similar fashion to bracket assembly 338, bracket assembly 538 does not incorporate the use of a strap surrounding forward catalytic converter 16.

An externally threaded stud 651 is fixed to an outer surface 549 of forward catalytic converter 16. First and second seats 653, 655 are positioned at the distal ends of bifurcated bracket 568. A first open ended slot 657 extends through first seat 653. A second open ended slot 659 extends through second seat 655. Another stud (not shown) is also fixed to forward catalytic converter 16 substantially diametrically opposed from stud 651. The studs radially outwardly extend from catalytic converter 16 and may be translated into open ended slots 657, 659 during the exhaust system assembly process. A nut 661 is threadingly engaged with stud 651 to mount forward catalytic converter 16 to first seat 653. Another nut 663 cooperates with the other stud to fix forward catalytic converter 16 to second seat 655. The provision of recess 633 assures that load is transferred from forward catalytic converter 16 through first seat 653 and second seat 655 while the remaining portions of outer surface 549 are clear of bracket 568. As such, a first hinge 665 and a second hinge 667 are provided to complement third hinge 612 as previously described.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system for mounting a catalytic converter of an exhaust system to an internal combustion engine, the mounting system comprising:

a bracket adapted to fix the catalytic converter to the engine; and a strap adapted to circumferentially extend about a portion of the catalytic converter and clamp the catalytic converter to the bracket, wherein the bracket includes a seat to support a portion of the catalytic converter opposite the strap, a mounting pad and a compliant portion interconnecting the seat and the mounting pad, the compliant portion including a slot circumferentially extending adjacent to the seat at an angle greater than ninety degrees to reduce the stiffness of the bracket and allow the bracket to deflect during thermal expansion of the catalytic converter, the seat circumferentially extending an angle greater than one hundred degrees and including a substantially cylindrically shaped surface adapted to engage the catalytic converter, the cylindrically shaped surface including a longitudinal axis extending parallel to the mounting pad.

2. The system of claim 1, wherein the compliant portion includes a substantially flat, constant thickness, plate having a circumferentially extending rib adjacent to the slot.

3. The system of claim 2, further including an upturned flange extending along an outer portion of the mounting pad.

4. A system for mounting a catalytic converter of an exhaust system to an internal combustion engine, the mounting system comprising:

a bracket adapted to fix the catalytic converter to the engine; and a strap adapted to circumferentially extend about a portion of the catalytic converter and clamp the catalytic converter to the bracket, wherein the bracket includes a seat to support a portion of the catalytic converter opposite the strap, a mounting pad and a compliant portion interconnecting the seat and the mounting pad, the compliant portion including a slot extending adjacent to the seat to reduce the stiffness of the bracket and allow the bracket to deflect during thermal expansion of the catalytic converter, wherein the seat, the mounting pad, and the compliant portion are portions of a contiguous, constant thickness panel.

5. The system of claim 4, wherein the panel includes a stamped metal sheet.

6. The system of claim 1, wherein the compliant portion includes a Y-shaped spring section including spaced apart distal ends, the strap having opposite ends coupled to the distal ends.

7. The system of claim 6, wherein one end of the strap is pivotally coupled to the bracket.

8. The system of claim 7, wherein the strap includes eyelets in receipt of a pin to form a pivot joint.

9. The system of claim 1, wherein the mounting pad extends at substantially ninety degrees to the compliant portion.

10. A system for mounting a catalytic converter of an exhaust system to an internal combustion engine, the mounting system comprising:

a bracket adapted to fix the catalytic converter to the engine; and a strap adapted to circumferentially extend about a portion of the catalytic converter and clamp the catalytic converter to the bracket, wherein the bracket includes a seat to support a portion of the catalytic converter opposite the strap, a mounting pad and a compliant portion interconnecting the seat and the mounting pad, the compliant portion including a slot extending adjacent to the seat to reduce the stiffness of the bracket and allow the bracket to deflect during thermal expansion of the catalytic converter, wherein the bracket includes a first hinge having a reduced cross-section positioned between the mounting pad and the compliant portion, the first hinge allowing relative movement between the mounting pad and the seat to distribute stress during thermal growth of the catalytic converter.

11. The system of claim 10, wherein the bracket includes a second hinge having a reduced cross-section by being positioned at one of the ends of the slot and a third hinge having a reduced cross-section by being positioned at the other end of the slot.

12. A system for mounting a catalytic converter of an exhaust system to an internal combustion engine, the mounting system comprising:

a monolithic bracket having a substantially constant thickness and being adapted to fix the catalytic converter to the engine, the bracket including a seat adapted to support a portion of the catalytic converter; and a mounting pad and a compliant portion interconnecting the seat and the mounting pad, the compliant portion including first, second and third hinges having reduced cross-sections to allow relative movement between the seat and the mounting pad during thermal expansion of the catalytic converter.

13. The system of claim 12, wherein the mounting pad extends at substantially ninety degrees to the compliant portion and the first hinge is positioned at their juncture.

14. The system of claim 13, wherein a slot circumferentially extends adjacent to the seat an angle greater than ninety degrees.

15. The system of claim 14, wherein the second and third hinges are positioned at the ends of the slot.

16. The system of claim 14, wherein the slot defines a Y-shaped leaf spring.

17. The system of claim 12, further including a strap adapted to circumferentially extend about a portion of the catalytic converter and clamp the catalytic converter to the bracket.

18. The system of claim 17, wherein one end of the strap is pivotally coupled to the bracket.

19. The system of claim 12, further including another seat circumferentially spaced apart from the seat and being adapted to support a portion of the catalytic converter, wherein the first hinge is positioned proximate the seat and the second hinge is positioned proximate the another seat.

20. The system of claim 19, wherein the seat and the another seat are adapted to be fixed to the catalytic converter with the remaining portions of the bracket adapted to be spaced apart from the catalytic converter.

21. The system of claim 20, wherein the seat includes a slot adapted to receive a fastener for fixing the catalytic converter to the bracket.

* * * * *